US007964080B2

(12) United States Patent
Mörnholm

(10) Patent No.: US 7,964,080 B2
(45) Date of Patent: Jun. 21, 2011

(54) DEVICE AND METHOD FOR HANDLING METAL SHEETS

(75) Inventor: Bengt Mörnholm, Kil (SE)

(73) Assignee: Outotec Oyj, Espoo (FI)

( * ) Notice: Subject to any disclaimer, the term of this patent is extended or adjusted under 35 U.S.C. 154(b) by 1124 days.

(21) Appl. No.: 11/574,129

(22) PCT Filed: Aug. 26, 2005

(86) PCT No.: PCT/FI2005/000368

§ 371 (c)(1),
(2), (4) Date: Feb. 22, 2007

(87) PCT Pub. No.: WO2006/021617

PCT Pub. Date: Mar. 2, 2006

(65) Prior Publication Data

US 2007/0272561 A1 Nov. 29, 2007

(30) Foreign Application Priority Data

Aug. 27, 2004 (FI) ..... 20041122

(51) Int. Cl.
*C25D 1/04* (2006.01)

(52) U.S. Cl. ..... 205/76; 204/198

(58) Field of Classification Search ..... 205/76
See application file for complete search history.

(56) References Cited

U.S. PATENT DOCUMENTS

| | | | | | |
|---|---|---|---|---|---|
| 3,124,521 | A | * | 3/1964 | Sviadoshch et al. | 204/194 |
| 3,501,385 | A | * | 3/1970 | Jasberg | 205/76 |
| 3,533,887 | A | * | 10/1970 | Jasberg | 156/584 |
| 3,625,806 | A | * | 12/1971 | Wennberg | 266/249 |
| 3,883,403 | A | * | 5/1975 | Ettel et al. | 205/76 |
| 3,935,091 | A | * | 1/1976 | Rautimo et al. | 204/281 |
| 4,304,650 | A | | 12/1981 | Matsuo et al. | |
| 4,417,953 | A | * | 11/1983 | Viellefont et al. | 205/76 |
| 4,479,854 | A | * | 10/1984 | Willans et al. | 205/76 |
| 4,840,710 | A | * | 6/1989 | Middlin et al. | 156/344 |
| 5,149,410 | A | * | 9/1992 | Robinson et al. | 204/199 |

FOREIGN PATENT DOCUMENTS

| | | |
|---|---|---|
| JP | 60218254 | 10/1985 |
| WO | 0146052 | 6/2001 |
| WO | WO 2005071142 A1 * | 8/2005 |

* cited by examiner

*Primary Examiner* — Harry D Wilkins, III
*Assistant Examiner* — Bryan D. Ripa
(74) *Attorney, Agent, or Firm* — Chernoff, Vilhauer, McClung & Stenzel

(57) ABSTRACT

The invention relates to a turning device for metal deposits used in combination with a separating device, comprising at least one turnable receiving unit mounted on a rotating axle under the separating device and in the vicinity of at least one conveyor, guiding means for guiding a metal deposit to a receiving unit acting as a turning device and means for rotating the receiving unit. The invention also relates to a method for handling metal deposits.

15 Claims, 6 Drawing Sheets

DEVICE AND METHOD FOR HANDLING METAL SHEETS

This is a national stage application filed under 35 USC 371 based on International Application No. PCT/FI2005/000368 filed Aug. 26, 2005, and claims priority under 35 USC 119 of Finnish Patent Application No. 20041122 filed Aug. 27, 2004.

FIELD OF INVENTION

This invention relates to device and method for handling metal sheets. More specifically it relates to a turning device and method for turning metal sheets used in connection with device separating metal deposit from a cathode.

BACKROUND OF THE INVENTION

The refining of many metals, such as copper, zinc and nickel, includes electrolytic process where harmful impurities are separated from the metal to be produced. The metal produced in the electrolytic process is gathered to the cathode by means of electric current. Usually the electrolytic process is carried out in tanks filled with an electrolyte containing sulphuric acid and, immersed therein, a number of plate like anodes and cathodes made of some electroconductive material and placed in an alternating fashion. At the top edges the anodes and cathodes are provided with lugs or bars for suspending them at the tank edges and for connecting them to the power circuit. The cathodes, i.e. the mother plates, used in the electrolytic process are made for of instance stainless steel, aluminium or titanium.

After the electrolytic process the anodes are removed from the tanks and the metal from the surface is removed for further processing. To the removing of the metal from the anode are used many various methods. For example the metal plate is opened slightly from one edge of the anode plate, grabbed with grip members and pulled apart from the anode. Other possibility is to cut the metal from the surface of the anode with cutting blades.

To maintain the production continuous there are developed devices for separating the metal deposit from the cathode. The devices are constructed roughly with two parts, the separating part and the turning part. In the separating part the metal is separated from the anode and in the turning part the separated metal parts are turned and moved further treatment in the process.

In documents U.S. Pat. No. 5,149,410 and WO 00/32846 are described such prior art devices. In U.S. Pat. No. 5,149,410 are described a method and apparatus for stripping electrodeposited metal sheets from permanent cathodes comprising a rotating carousel for receiving and sequentially advancing suspended permanent cathodes having electrodeposited metal sheets to a plurality of stations about the carousel including a loading station, a hammering station for loosening the upper edges of the metal sheets from the cathodes, an opening station for stripping of the metal sheets from the cathodes, a discharge station for discharge of pairs of metal sheets, and an unloading station for removal of stripped cathodes. The pairs of stripped metal sheets preferably are bottom discharged to a vertical envelope, which is rotated to a horizontal position for removal of metal sheets.

In document WO 00/32846 are described another device for separating metal deposit from a mother plate used as a cathode in an electrolytic process. In that device the metal sheets are separated and at the same time tilted from vertical position to horizontal position by gripping members guided with curved guides and then discharged from the device.

SUMMARY OF THE INVENTION

The object of the invention is to produce a device with fewer moving parts making it more reliable and compact. The device is also faster, which gives the opportunity to speed up the stripping process and more quiet than prior art devices. The same advantages are present also in related method for handling metal sheets.

Another object of the invention is to combine the separating device with the turning device to a compact design and more efficient method for handling metal sheets.

With one embodiment of the invention it is possible to alternatively unload the metal sheets to both sides of the stripping device. This is creating better and even more squared bundles, which are advantageous for further processing.

These above mentioned objects are achieved by a device and a method described later in the independent claims. In the dependent claims are presented other advantageous embodiments of the invention.

BRIEF DESCRIPTION OF THE DRAWINGS

In the following the preferred embodiments are described in more details with reference to the accompanying drawings, where.

DETAILED DESCRIPTION OF THE PREFERRED EMBODIMENTS

Figure 1:
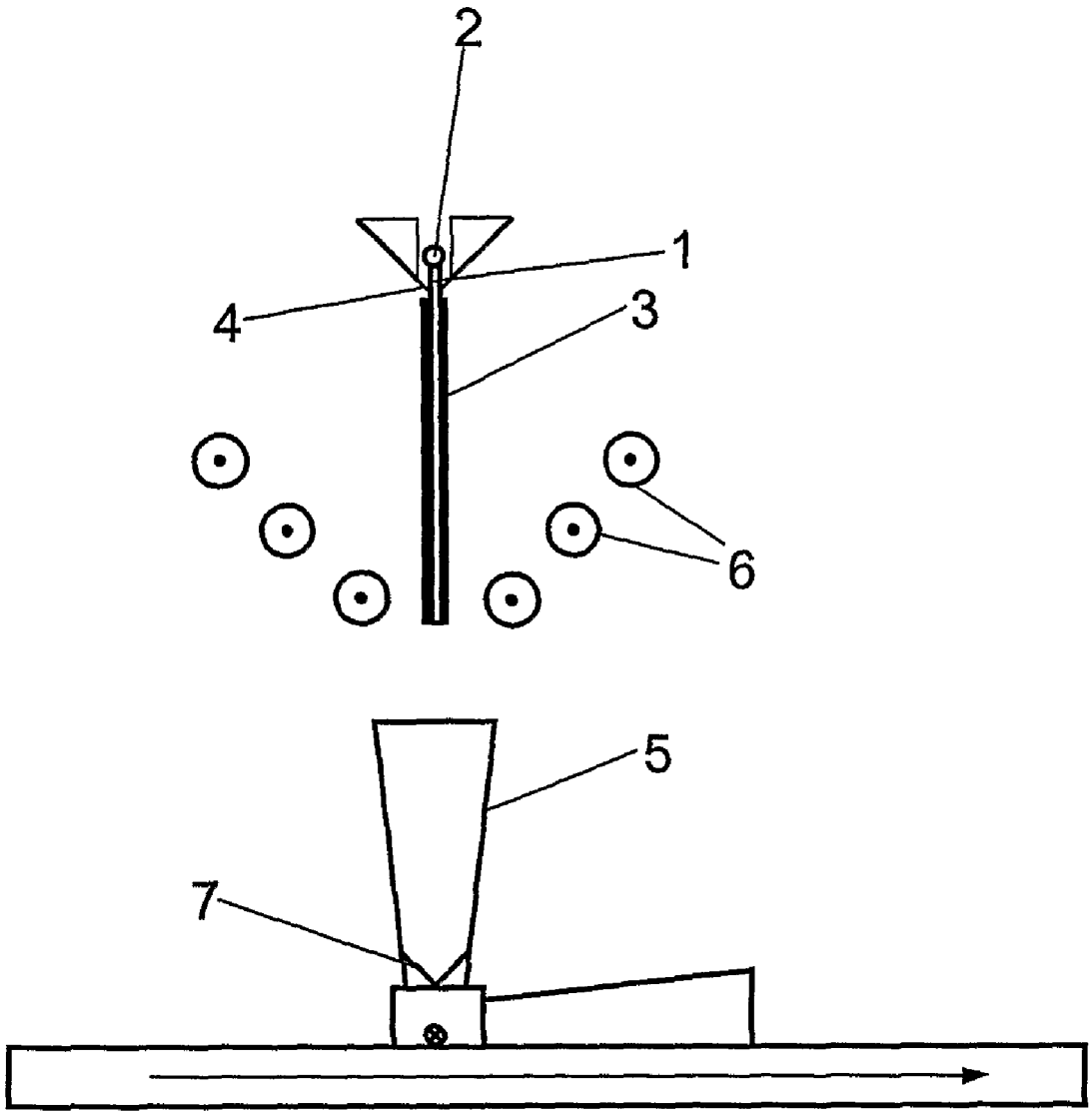
FIG. 1 is a simplified view of the first embodiment of the turning device.

In FIG. 1 the plate shaped permanent cathode 1 is held in its position from the hanger bar 2 and the metal deposit 3 is surrounding the permanent cathode from both sides. The separation of the metal deposit 3 is done by two vertically moving knives 4, which are waiting at the upper position. The knives 4 wedge the permanent cathode 1 free on both sides from the metal deposit 3. For the separation of the metal deposit 3 can be used also any other known method.

The receiver unit 5 is waiting under the permanent cathode 1 for the metal deposit 3 to be separated. The receiver unit has a V-shaped construction for easy receiving of the metal deposit 3 but the design is not limited to this example and can be freely alternated. On both sides of the permanent cathode 1 are situated guiding means, which are for example rollers 6. The receiver unit 5 under the permanent cathode 1 has a bottom 7 that can be opened.

Figure 2:
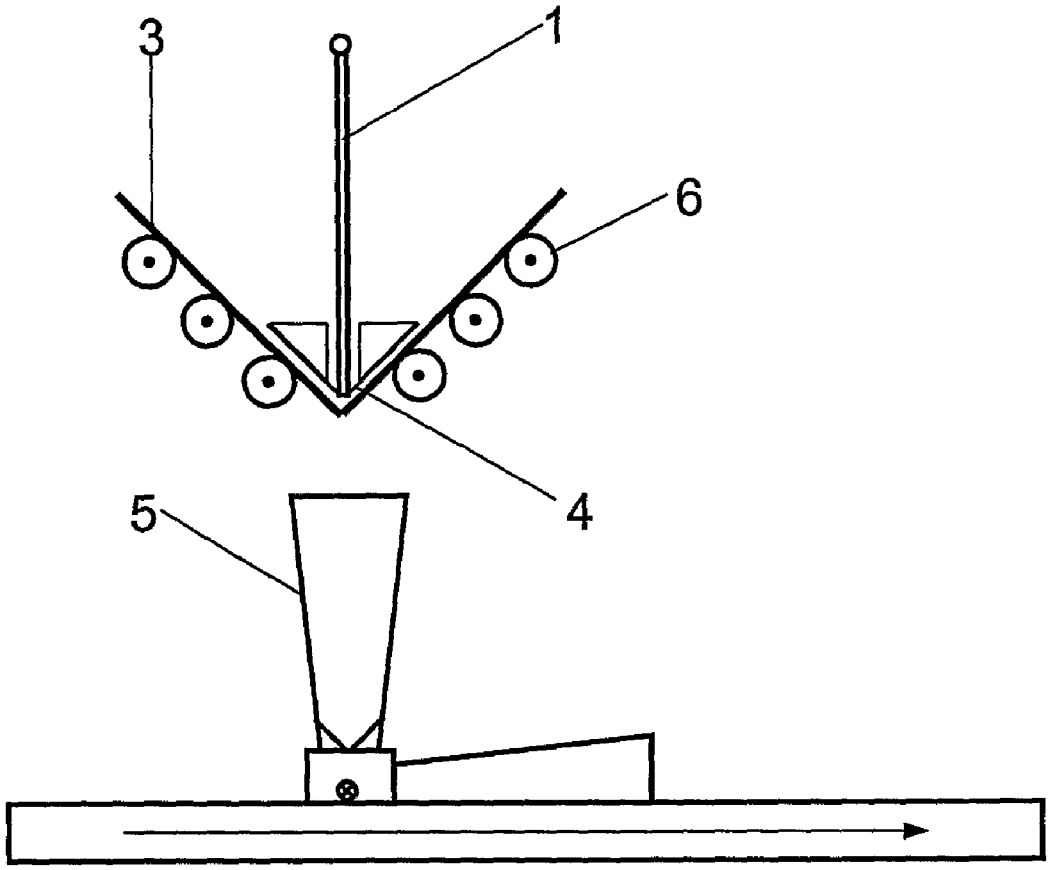
FIG. 2 is another drawing of the first embodiment.

In FIG. 2 the knives 4 have moved to the lower position and separated the metal deposit 3 from the permanent cathode 1 and the separated metal deposit is tilted against the support rollers 6. Next the knives 4 are moving back to the upper position and the metal deposit 3 is moved by gravity to the waiting receiver unit 5 under the permanent cathode 1.

Figure 3:
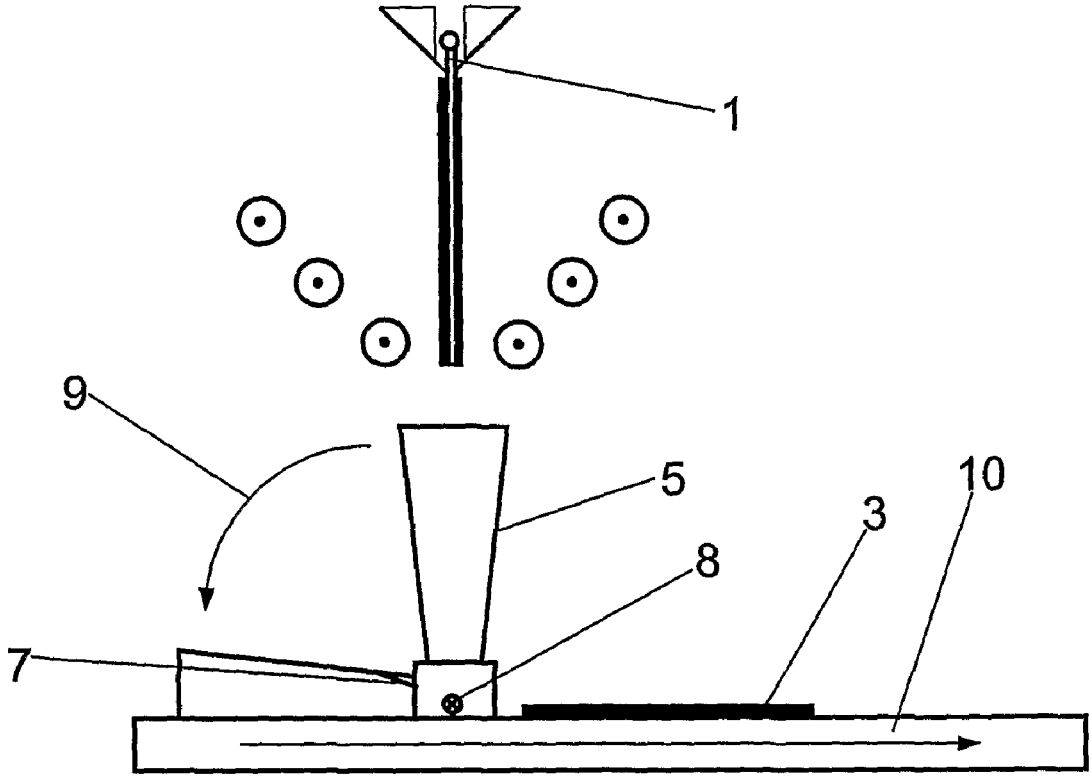
FIG. 3 is yet another drawing of the first embodiment.
Figure 3A:
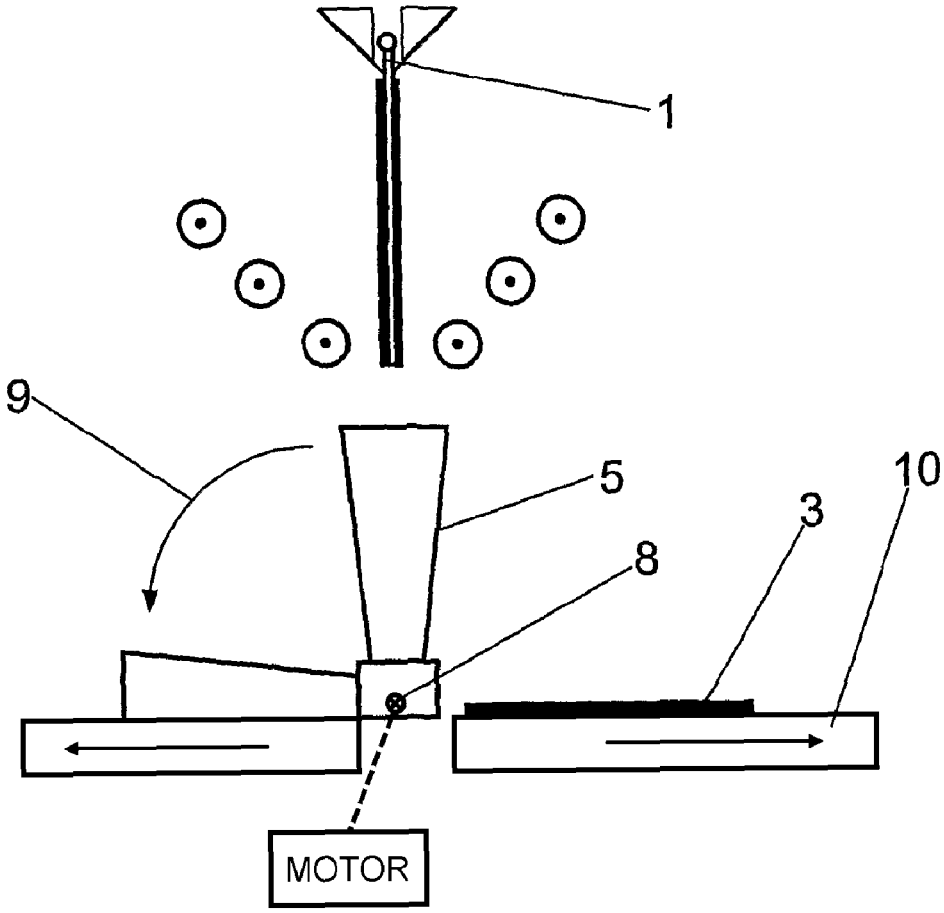

In FIG. 3 the receiver unit 5 is acting as a turning device and tilted 90 degrees from vertical position to the lateral position around the turning axle 8 according to the arrow 9 and the bottom 7 of the receiving unit 5 is opened. The receiver unit 5 lays the metal deposit 3 to the conveyor 10, which moves the metal deposit further in the process. At the same time another receiving unit 5, which has solid bottom, is moved under the metal deposit 3 separation process and another permanent cathode 1 is switched to the separation device. This is due the fact that the two receiving units 5 are assembled at 90 degrees angle in relation to each other and the units are moved 90 degrees back and forth. Therefore always when another unit is unloading metal deposit 3 to the conveyer 10 the other is waiting next metal deposit from the separation. The construction of the turning device can naturally be made with just one receiving unit 5 but the process is then slower than with the device having two receiving units. Also the construction can have two conveyors 10 moving the metal deposits 3 into two opposite directions from the turning device and both receiving units 5 can then have solid bottoms. The turning of the receiver units 5 is done by any known mechanical construction. For example it can be driven by means of motor and gearbox or by a hydraulic cylinder.

By turning back and forth the turning device is unloading the metal deposits 3 to both sides of the separation device. This is advantageous for later bundling of the metal deposits 3. The bundles are better and even more squared than when the metal deposits 3 are continuously unloaded to same direction. The turning device is constructed of one or more separate pieces at the transverse direction of the conveyor 10 and located on both sides of and/or in the middle of the unloading conveyor.

Figure 4:
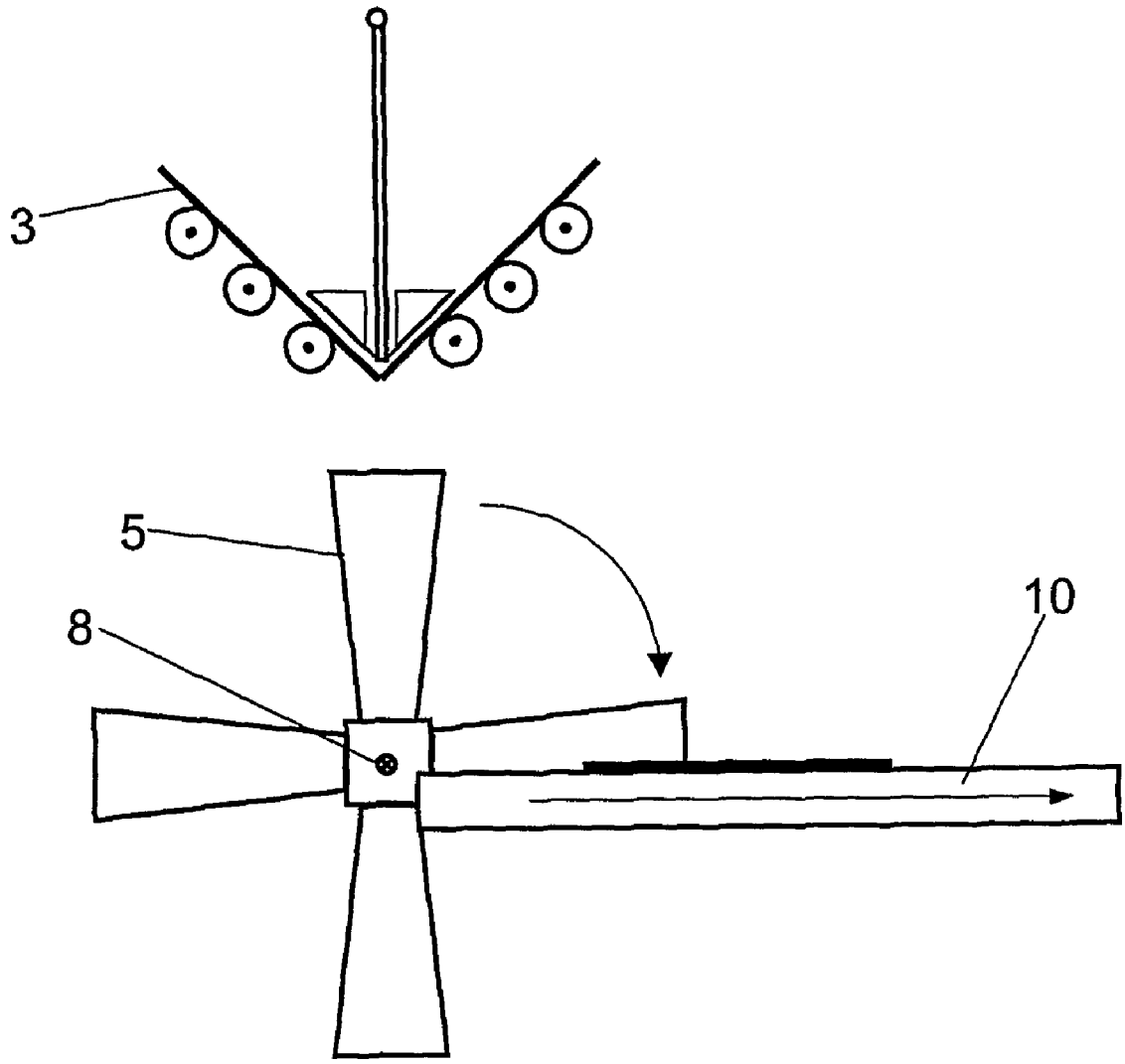
FIG. 4 is a simplified view of the second embodiment of the turning device.

In FIG. 4 there are another embodiment of the turning device. The turning device has four receiving units 5 assembled around the turning axle 8 in 90-degree intervals. The turning device is rotating only in one direction and unloading the metal deposits 3 to one conveyer 10. The next receiving unit 5 is automatically moving to the position for next metal deposit 3 when at same time the previous receiving unit is unloading metal deposit to the conveyer 10. Here is presented only the embodiment with four receiving units 5 but it is possible to increase the number of receiving units to for example eight, twelve and so on. The only limiting thing for smooth operation between the turning devise and the separation device is that at the same time there is one empty receiving unit 5 waiting for next metal deposit 3 when another is unloading metal deposit to the conveyer 10.

Figure 5:
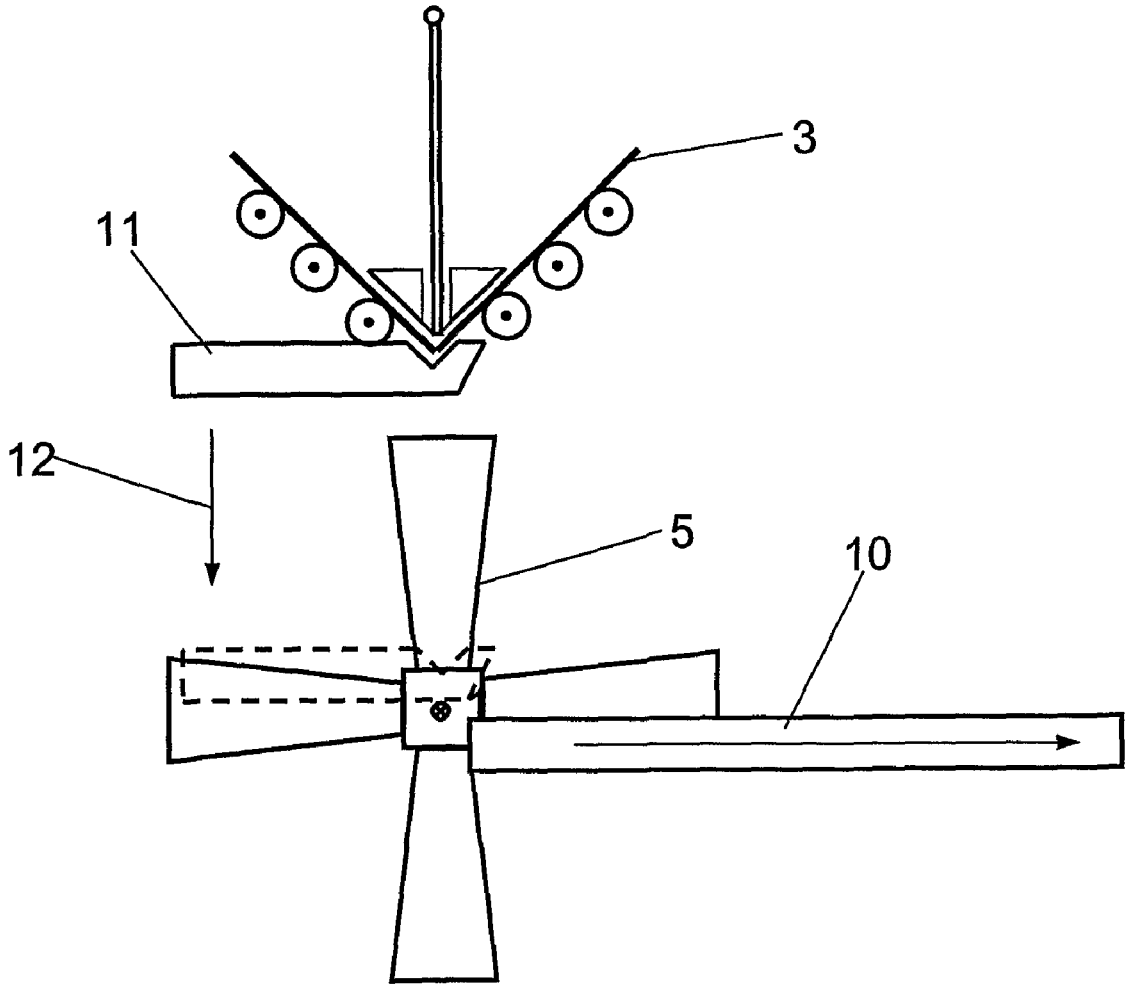
FIG. 5 is a simplified view of the third embodiment of the turning device.

In FIG. 5 is presented an embodiment with lowering device 11. In this embodiment the metal deposit 3 is lowered in a controlled way to the receiving unit 5 according the arrow 12. The lowered position is described with dashed line. Lowering the metal deposit 3 to the receiving unit 5 is reducing the noise of the device. After that the receiving unit 5 is working as a turning device and passes the metal deposit 3 to the conveyer 10. At the same time when the receiving unit 5 is turning towards the conveyer 10 the lowering device 11 is raised back to the upper position for receiving the next metal deposit 3 to be lowered to the next receiving unit 5.

The above described devise and method are suitable for all different kinds of cathodes used in electrolytic processes. By above described way the turning device is combined with the separation device and more compact design is achieved. This reduces the amount of movable parts compared to the prior art devices. It also makes possible to speed up the separating unit.

While the invention has been described with reference to its preferred embodiments, it is to be understood that modifications and variations will occur to those skilled in the art. Such modifications and variations are intended to fall within the scope of the appended claims.

The invention claimed is:

1. Apparatus for handling metal deposits separated from cathodes, comprising:

a separating device for separating a metal deposit from a cathode, a turning device that comprises at least two receiving units that are angularly spaced about a turning axis under the separating device and extend radially from the turning axis, the turning device being turnable about the turning axis whereby a given receiving unit can be moved from a receiving position for receiving a metal deposit from the separating device to a discharge position for discharging the metal deposit, a mechanism for rotating the turning device about the turning axis, and at least one conveyor positioned for receiving a metal deposit discharged from a receiving unit in the discharge position.

2. Apparatus according to claim 1, wherein the turning device comprises two receiving units that are angularly spaced by 90° about the turning axis.

3. Apparatus according to claim 2, wherein one of the two receiving units has a bottom that can be opened, allowing discharge of a metal deposit from the bottom of said one receiving unit, and said mechanism is operative to rotate the turning device alternately in opposite directions about the turning axis.

4. Apparatus according to claim 2, comprising first and second conveyors and wherein said mechanism is operative to rotate the turning device alternately in opposite directions about the turning axis, whereby one of the two receiving units discharges to the first conveyer when in the discharge position and the other of the two receiving units discharges to the second conveyer when in the discharge position.

5. Apparatus according to claim 1, wherein the turning device comprises four receiving units that are angularly spaced at 90° .

6. Apparatus according to claim 1, further comprising a lowering device for lowering the metal deposit from the separating device to a receiving unit in the receiving position.

7. Apparatus according to claim 1, comprising a guide for guiding a metal deposit that has been separated from a cathode by the separating device to a receiving unit in the receiving position.

8. Apparatus for handling metal deposits separated from cathodes, comprising:

a separating device for separating a metal deposit from a cathode, a turning device that comprises first and second receiving units that are angularly spaced about a turning axis under the separating device and extend radially from the turning axis, the turning device being turnable about the turning axis whereby the first receiving unit can be moved from a receiving position for receiving a metal deposit from the separating device to a first discharge position for discharging the metal deposit and the second receiving unit can be moved from the receiving position for receiving a metal deposit from the separating device to a second discharge position, distinct from the first discharge position, for discharging the metal deposit, a mechanism for rotating the turning device about the turning axis, and at least one conveyor positioned for receiving a metal deposit discharged from a receiving unit in the discharge position.

9. Apparatus for handling metal deposits separated from cathodes, comprising:

a separating device for separating a metal deposit from a cathode, a turning device that comprises a multiple of four receiving units that are angularly spaced about a turning axis under the separating device and extend radially from the turning axis, the turning device being turnable about the turning axis whereby a given receiving unit can be moved from a receiving position for receiving a metal deposit from the separating device to a discharge position for discharging the metal deposit, a mechanism for rotating the turning device about the turning axis, and at least one conveyor positioned for receiving a metal deposit discharged from a receiving unit in the discharge position.

10. A method for handling metal deposits attached to permanent cathodes, comprising the steps of:

providing a turning device that comprises at least two receiving units that are angularly spaced about a turning axis under a separating location and extend radially from the turning axis, the turning device being turnable about the turning axis whereby a given receiving unit can be moved from a receiving position for receiving a metal deposit from the separating location to a discharge position for discharging the metal deposit, separating a first metal deposit from a first permanent cathode at the separating location;

receiving the first metal deposit in a first receiving unit at the receiving position; and turning the turning device around its turning axis to position the first receiving unit at the discharge position of the first receiving unit, for discharging the first metal deposit to a conveyor, and concurrently positioning a second receiving unit at the receiving position.

11. A method according to claim 10, comprising turning the turning device in a first direction about its turning axis to position the first receiving unit at the discharge position of the first receiving unit, and the method further comprises separating a second metal deposit from a second permanent cathode at the separating location, receiving the second metal deposit in the second receiving unit at the receiving position, and turning the turning device around its turning axis in a second direction, opposite said first direction, to position the second receiving unit at the discharge position of the second receiving unit and concurrently position the first receiving unit at the receiving position.

12. A method according to claim 11, comprising discharging the first metal deposit from the bottom of the first receiving unit and discharging the second metal deposit from the top of the second receiving unit.

13. A method according to claim 10, comprising discharging the first metal deposit from the top of the first receiving unit and discharging the second metal deposit from the top of the second receiving unit.

14. A method according to claim 10, wherein the turning device comprises four receiving units that are angularly spaced at 90° about the turning axis and the method comprises turning the turning device in a first direction about its turning axis to position the first receiving unit at the discharge position, separating a second metal deposit from a second permanent cathode at the separating location, receiving the second metal deposit in the second receiving unit at the receiving position, turning the turning device around its turning axis in said first direction to position the second receiving unit at the discharge position and concurrently position a third receiving unit at the receiving position, separating a third metal deposit from a third permanent cathode at the separating location, receiving the third metal deposit in the third receiving unit at the receiving position, turning the turning device around its turning axis in said first direction to position the third receiving unit at the discharge position and concurrently position a fourth receiving unit at the receiving position.

15. A method according to claim 10, comprising lowering the first metal deposit to the first receiving unit in controlled fashion.

* * * * *